United States Patent [19]

Roberts

[11] 3,969,828

[45] July 20, 1976

[54] MEANS TO VIBRATE CHAIN LINK FABRIC

[76] Inventor: Keith E. Roberts, P.O. Box 485, Huntsville, Ala. 35804

[22] Filed: Aug. 23, 1974

[21] Appl. No.: 499,930

Related U.S. Application Data

[62] Division of Ser. No. 330,118, Feb. 6, 1973, Pat. No. 3,845,741.

[52] U.S. Cl. ..... 34/14; 34/152; 134/64 R; 198/DIG. 15; 209/308; 226/77; 226/87

[51] Int. Cl.[2] ..... F26B 13/12

[58] Field of Search ..... 118/57, 419; 226/87, 226/77; 209/308, 324, 470; 134/1, 15, 64, 126, 75; 34/14, 152; 198/220 A, DIG. 15

[56] References Cited

UNITED STATES PATENTS

| | | | |
|---|---|---|---|
| 710,981 | 10/1902 | Jessup | 209/308 |
| 1,232,052 | 7/1917 | Landahl | 209/308 |
| 1,489,076 | 4/1924 | Harter | 118/419 X |
| 1,623,593 | 4/1927 | Harter | 118/57 X |
| 2,960,777 | 11/1960 | Doll | 34/152 X |
| 3,545,095 | 12/1970 | Dokoupil | 34/164 X |

*Primary Examiner*—Morris Kaplan
*Attorney, Agent, or Firm*—Craig & Antonelli

[57] ABSTRACT

An apparatus and method for removing excess coating material from chain link fabric during the manufacture of the fabric. A gang of sprocket members are arranged side-by-side on a shaft for rotation about the shaft axis. Each of the sprocket members includes a plurality of radially outwardly extending teeth having notches formed along the length thereof. Chain link fabric is passed over the gang of sprockets such that the teeth engage through respective openings formed by the wire or other members of the fabric. When the fabric is removed from the sprockets, the notches in the teeth cause intermittent hitching and release of the fabric which vibrates the fabric to remove excess molten coated material from the fabric. The gang of sprockets is arranged intermediate a coating tank and a cooling tank for the chain link fabric such that the coating material is in the molten state when it passes over the sprockets. The sprocket members are dimensioned slightly smaller than the openings in the chain link fabric and the notches are configured so as to permit relatively smooth movement of the teeth into the openings in the fabric while providing a vibration inducing interengagement between the notches and fabric members upon withdrawal of the fabric from the sprockets.

18 Claims, 6 Drawing Figures

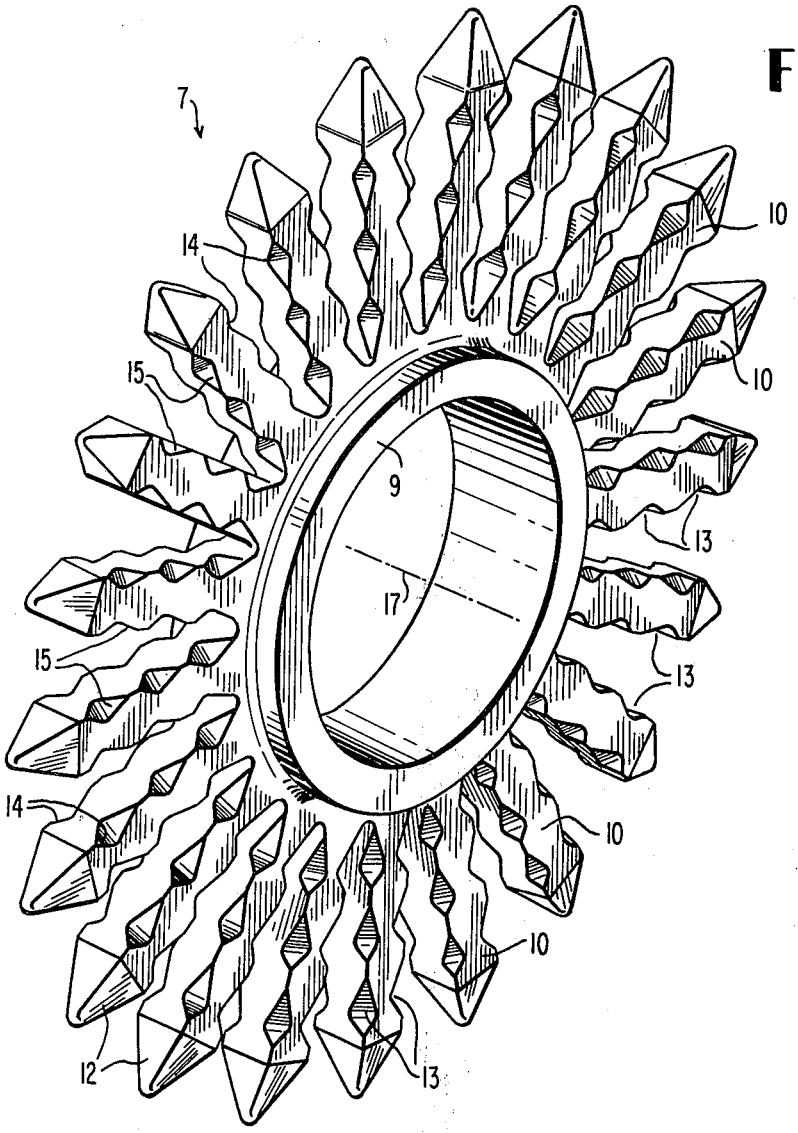
FIG. 2
FIG. 4
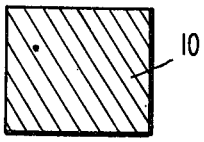
FIG. 5
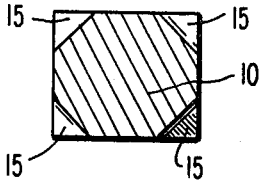
FIG. 6
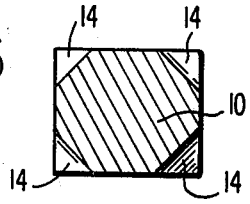
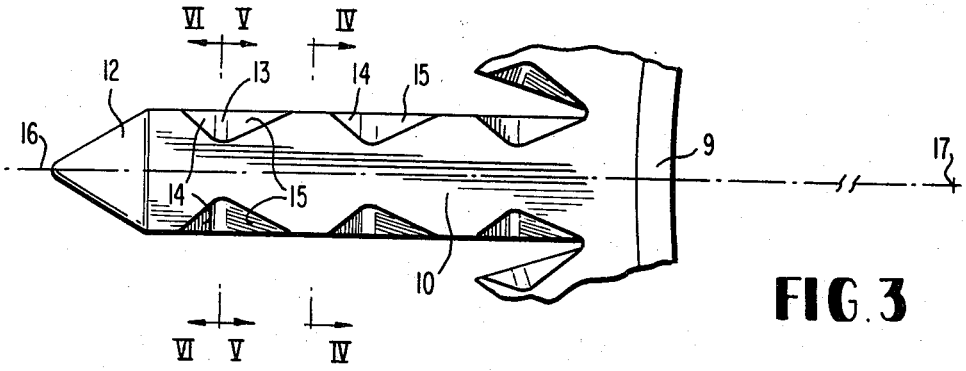
FIG. 3

MEANS TO VIBRATE CHAIN LINK FABRIC

This is a continuation, division of application Serial No. 330,118 filed Feb. 6, 1973, now Patent No. 3,845,741.

BACKGROUND AND SUMMARY OF THE INVENTION

The present invention relates to an improved apparatus for manufacturing coated chain link fabric, especially chain link fabric of the type used in chain link fences and the like.

It is generally known to coat chain link fabric of the type having a plurality of intersecting wire-like members defining openings therebetween with a coating material to improve the wear characteristics and the appearance of the chain link fabric. In many instances, these coating materials consist of non-ferrous metallic coatings that are applied by passing the chain link fabric through a tank of the molten coating material and then cooling the fabric and coating material so as to harden the coating material on the fabric. For example, a chain link fabric made up of steel wire-like members may be coated with molten zinc, tin plate, or the like, using sequentially arranged coating and cooling tanks.

An important problem that occurs with the above-mentioned type of coating of chain link fabric relates to the uneven distribution of the coating material, which uneven coating is caused by the geometry of the intersections of the wire-like members in the fabric and by the different gravity effects on the molten coating during the manufacture. That is, the intersections tend to experience an excessive build up of the molten material and the underside of the wire-like members also tends to experience teat formation or excessive build up of the molten coating material.

The uneven coating of the chain link fabric prevents several basic disadvantages. First, the appearance of the finished product is substantially impaired by the uneven distribution and metal coating test formations. Also, the excess build up at the joints or intersections of the wire-like members of the fabric may freeze up the joints and prevent relative sliding movement of the wires at the joint, which results in an impairment of the operation of the chain link fabric during use. A still further disadvantage of the uneven coating relates to the relatively high cost for the coating material as compared to the basic wear-like members. Since the coating materials are usually much more expensive than the material being coated, and further since the utility of the coating as regards wear-resistance, weather-resistance, and the like is not substantially improved by the relatively thick excess build up of the coating material, the uneven coating results in excess expenditures for the coating material without a corresponding improvement in the end product.

It has been contemplated to attempt to overcome this uneven coating problem by striking the fabric with a wiper or flat piece that hits the wire and leaves a mark. With this so-called wiping method, the movement of the flat piece of metal is controlled by a motor. However, this method has the disadvantage that the wire of the chain link fabric is struck so as to leave a mark and the disadvantage that complicated motor and transmission mechanisms are needed to control the movement of the flat piece of metal that is to strike the fabric.

The present invention contemplates an improved apparatus for removing the excess coating material from the chain link fabric during the manufacture of the fabric. In one aspect, the present invention contemplates the method including the successive steps of passing coated chain link fabric over at least one sprocket member such that respective teeth of the sprocket member extend through openings in the fabric, and removing the fabric from the sprocket member such that the interengagement of the teeth and the fabric member upon removal of the teeth from the openings causes vibration of the fabric, which vibration causes excess coating material to fall from the fabric. A further aspect of the present invention involves the provision of notches along the length of the teeth on the sprocket member such that these notches cause a hitching and consequent vibration of the chain link fabric when the fabric is removed from the sprocket member. A further aspect of the present invention is the specific construction of the notches in the teeth of the sprocket member such that movement of the chain link fabric onto the teeth is relatively smooth while removal of the fabric from the teeth results in the hitching and vibration of the fabric to remove the excess coating material. A further aspect of the present invention is the provision of the sprocket members as one-piece cast members with a centrally disposed hub portion and radially outwardly extending teeth having a polygonal cross-sectional shape when viewed in the radial direction of the sprocket. The polygonal cross-sectional shape of the teeth can advantageously correspond to the polygonal cross-section of the openings in the chain link fabric being manufactured. A further constructional feature of the sprocket of the present invention is the arrangement of the outward ends of the teeth as pointed and tapering from the point to the polygonal cross-sectional shape so as to accommodate ready insertion of the teeth into the openings in the chain link fabric during the manufacturing operation.

The present invention also contemplates the arrangement of the sprockets intermediate a coating tank and a cooling tank with the chain link fabric being continuously guided through the coating tank over the sprockets and into the cooling tank and then onto a storage reel. This particular arrangement provides for a continuous manufacturing process whereby the removal of the excess coating material is done simply and in a continuous manner without interrupting the basic coating and cooling operations. The present invention also contemplates the arrangement of heating or flame mechanisms adjacent the sprocket members which heat the gang of sprockets so as to prevent annealing of the coating material to the sprocket structure. The present invention also contemplates the advantageous placement of the gang of sprockets such that the excess coating material removed during vibration of the fencing fabric by the sprockets is returned to the coating tank.

The above-discussed and other objects, features, and advantages of the present invention will become more apparent from the following description thereof, when taken in connection with the accompanying drawings.

BRIEF DESCRIPTION OF THE DRAWINGS

FIG. 2 is a perspective view of a single sprocket member in accordance with the present invention for vibrating the chain link fabric; and FIG. 3 is a partial view taken in the direction of the axis of rotation of the sprocket of FIG. 2 and showing a single tooth; and FIGS. 4 to 6 are cross-sectional views taken respectively along IV to VI of FIG. 3.

DETAILED DESCRIPTION OF THE DRAWINGS

Figure 1:
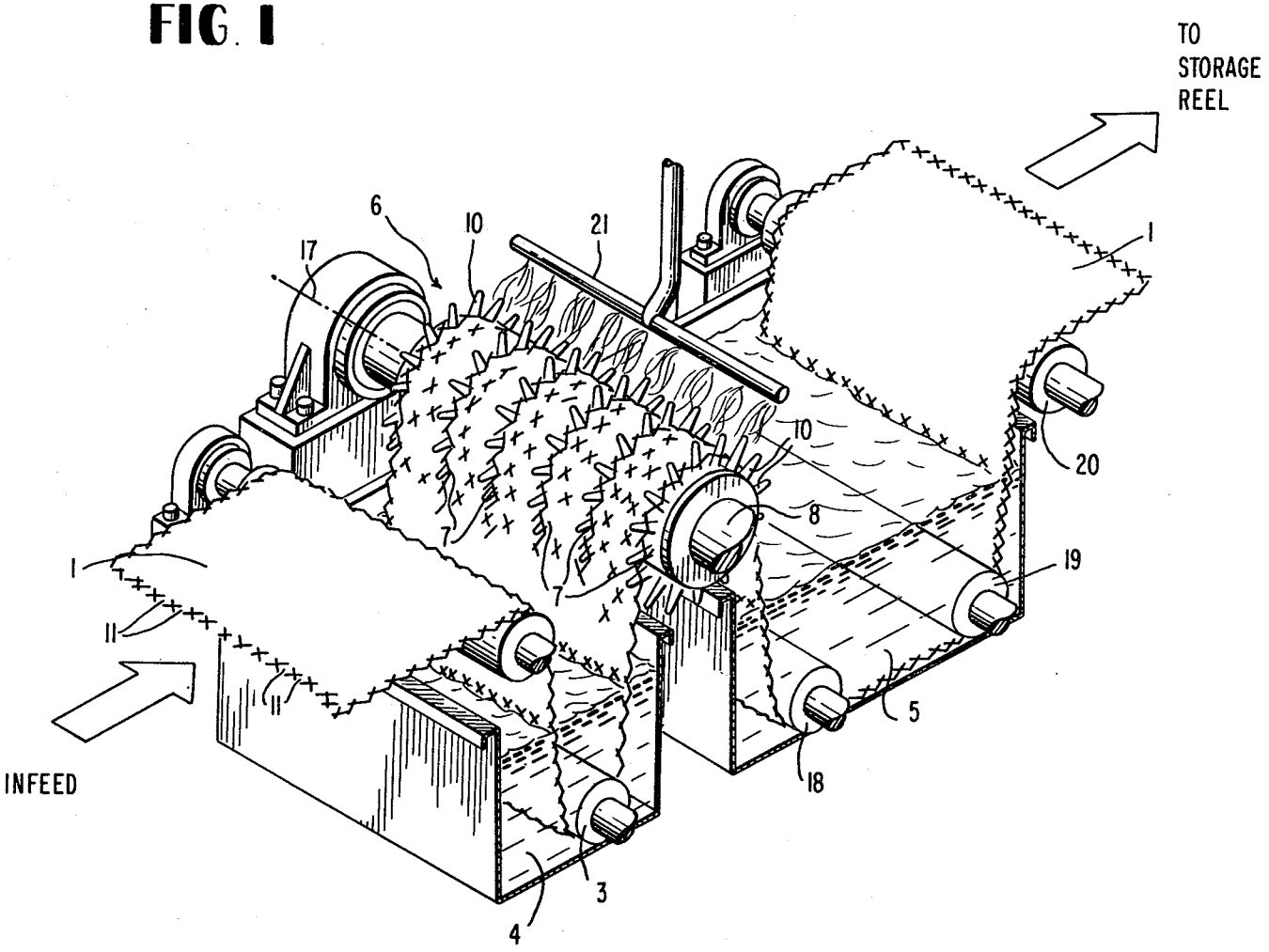
FIG. 1 is a schematic, partially cut away, view illustrating a method and apparatus for manufacturing chain link fencing fabric in accordance with the present invention.

Referring to the drawings, the chain link fencing fabric 1 is guided by rollers 2 and 3 for movement through a coating tank 4 of molten coating material. The fabric 1 is guided from the coating tank 4 to the cooling tank 5 by way of a gang of sprockets 6 including a plurality of individual sprocket members 7 arranged side-by-side for rotation about shaft 8.

As best seen in FIG. 2, each of the sprocket members 7 includes a centrally disposed hub portion 9 and a plurality of equally circumferentially spaced radially outwardly extending teeth 10. The teeth 10 have a polygonal cross-sectional shape along the majority of their length which corresponds to the shape of the openings 11 in the fencing fabric 1. The dimensions of the teeth 10 are slightly smaller than the openings 11 so as to accommodate insertion of the teeth through the openings as the fabric passes over the gang of sprockets 6. The outwardly extending tips 12 of the teeth are pointed and taper in a pyramid-like shape outwardly to the polygonal cross-section of the teeth, the tip portion 12 being readily insertable into the openings 11 in the fencing fabric 1.

Each of the teeth 10 is also provided with a plurality of notches 13 spaced along the longitudinal length of the teeth. In the preferred embodiment illustrated, the teeth are of a rectangular cross-sectional shape and the notches are formed along the respective lines of intersection of the sides of the teeth such that four sets of longitudinally spaced notches 13 are arranged in each tooth 10. Each of the notches includes a radially outward planar surface 14 which intersects at the bottom of the notch with radially inward planar surface 15. The surface 14 is inclined more steeply with respect to the radially extending axis of the tooth 10 than is the planar surface 15 such that the notches present a greater resistance to removal of the fabric than to insertion of the fabric onto the teeth 10. In other words, the fabric is more smoothly inserted over and onto the teeth 10 while it is hitched onto the steeper surface portions 14 to vibrate the fabric when the fabric is removed from the sprockets.

FIG. 3 is a view taken in the direction of axis of rotation 17 of the sprocket member 10 which shows the details of a single tooth 10. FIGS. 4 to 6 are further detailed views of the tooth shown in FIG. 3 taken along corresponding section lines IV to VI.

Referring again to FIG. 1, the fabric 1 is guided through cooling tank 5 by way of rollers 18, 19 and 20 and then onto a storage reel. In order to prevent the annealing of the coating material to the sprocket members or the sprocket member shaft 8, a heating or flame mechanism 21 is provided adjacent the gang of sprockets 6.

In the preferred illustrated embodiment, the chain link fabric is constructed of steel wires having openings of approximately 2¼ to 2½ inches while the sprocket cross-section dimension is approximately 2 inches. The coating material in tank 4 is molten zinc. The sprockets 7 are spaced approximately one foot from one another along the shaft 8. The sprocket member itself is made of steel which is manufactured by casting or stamping. The diameter of the sprocket member from the tip of one tooth 10 to the tip of the oppositely facing tooth 10 is on the order of 20 inches and the length of each of the individual teeth is approximately 5 inches. The rectangular cross-sectional dimensions of the individual teeth is approximately one inch by one-half inch with the shorter dimension in the direction of the axis 17. Each tooth has a total of 12 notches, three along each of the respective corners which are symmetrically placed with respect to the corner lines and which are relatively equally longitudinally spaced from one another along the length of the tooth. The particular inclination and dimensions of the surfaces 14 and 15 of the notches are as indicated in the drawings. However, it is noted that the specific dimension and materials given herein are by way of example only, and are included so as to enable one skilled in the art to practice the invention. It will also be understood that the particular dimensions of the sprocket members, the number of sprocket members, the particular material of the sprocket member, the particular material of the chain link fabric, the sizes and shapes of the openings in the fabric and the sizes and the shapes of the teeth on the sprocket members, the particular coating material, etc. may vary without departing from the present invention. For example, the coating material could be tin or any other non-ferrous metal coating. Also, the size of the openings in the chain link fabric will necessarily depend upon the particular end use to which the fabric is to be put. Also, the number of sprockets will necessarily increase depending on the height or length of chain link fabric being manufactured. The sprocket could be made of cast iron or hard aluminum as well as the above-described steel construction. The shaping of the notches and the points on the individual teeth may be done during the casting of the sprocket or may be later formed by other manufacturing or machining techniques.

Not only does the above-described preferred embodiment provide for an advantageous improvement in the appearance of the finished chain link fabric as well as a prevention of the freezing of the intersection joints of the wires forming the fabric, the present invention results in substantial savings of coating material, For example, the excessive zinc saved per 100 feet of 4 foot, 11 gauge wire chain link fabric is approximately 38 cents. Therefore, with large production runs, a large manufacture could save tens of thousands of dollars in the cost of excess zinc alone. It is noted that the excess zinc vibrated off the chain link fabric is collected and returned to the coating tank for the coating of further chain link fabric.

While I have shown and described one embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are within the scope of those skilled in the art.

I claim:

1. An arrangement for removing excess molten coating material from chain link fabric of the type having a plurality of openings formed between intersecting fabric members; said arrangement comprising:

at least one sprocket member having a plurality of outwardly projecting sprocket teeth, and means for movably guiding chain length fabric over a predetermined portion of the circumference of said at least one sprocket member such that portions of said teeth extend through respective openings in said fabric during movement of said fabric over said at least one sprocket member, wherein said teeth includes vibration inducing means configured and positioned with respect to said openings such that said teeth cause vibration of said fabric when said fabric is moved from a position with said portions of said teeth extending through said openings to a position with said portions of said teeth removed from said openings.

2. An arrangement according to claim 1, wherein said vibration inducing means includes at least one interrupted surface portion along the longitudinal extent of at least one of said teeth, said interrupted surface portion being engageable with the fabric members around the respective openings to cause said vibration of said fabric.

3. An arrangement according to claim 2, wherein each of said interrupted surface portions are formed as notches arranged along the longitudinal extent of said teeth.

4. An arrangement for removing excess molten coating material from chain link fabric of the type having a plurality of openings formed between intersecting fabric members; said arrangement comprising:

at least one sprocket member having a plurality of outwardly projecting sprocket teeth, and means for movably guiding chain length fabric over a predetermined portion of the circumference of said at least one sprocket member such that portions of said teeth extend through respective openings in said fabric during movement of said fabric over said at least one sprocket member, wherein said teeth are configured and positioned with respect to said openings such that said teeth cause vibration of said fabric when said fabric is moved from a position with said portions of said teeth extending through said openings to a position with said portions of said teeth removed from said openings, and wherein at least some of said teeth have a plurality of notches arranged along the longitudinal extent of said teeth, said notches being engageable with the fabric members around the respective openings to cause said vibration of said fabric.

5. An arrangement according to claim 4, wherein all of said teeth have said notches.

6. An arrangement according to claim 4, wherein said sprocket member includes a centrally disposed hub portion, wherein said teeth extend radially outwardly from said hub portion, wherein each of said teeth has a substantially polygonal cross-section when viewed in the radial direction of said hub portion, and wherein said notches are formed at respective intersections of the sides forming said polygonal cross-section.

7. An arrangement according to claim 6, wherein each of said notches are formed with two planar notch sides intersecting one another.

8. An arrangement according to claim 7, wherein each of said notches is formed symmetrically with respect to the respective intersection of the sides forming said polygonal cross-section.

9. An arrangement according to claim 8, wherein the two planar notch sides of a respective notch are inclined at different angles from one another with respect to a longitudinal tooth centerline extending through a respective one of said teeth, said tooth centerline extending radially of said hub portion.

10. An arrangement according to claim 9, wherein the planar surface of a notch which is disposed radially inwardly with respect to said hub portion is inclined to said tooth centerline at a smaller angle than the other planar surface of said notch.

11. An arrangement according to claim 10, wherein said polygonal cross-section is rectangular, and wherein the width of said teeth in the circumferential direction with respect to the hub portion is greater than the width of said teeth in the direction parallel to a centrally located axis of rotation of said hub portion.

12. An arrangement according to claim 11, wherein each of said teeth includes an outermost part which tapers from a point to said rectangular cross-section.

13. An arrangement according to claim 12, wherein said outermost part is shaped as a pyramid with the base of the pyramid corresponding to said rectangular cross-section.

14. An arrangement according to claim 13, wherein said hub portion and said teeth are formed as a one-piece casting.

15. An arrangement according to claim 14, wherein the radius of said hub portion is approximately one half of the radius of the circle formed by the points of said teeth.

16. An arrangement according to claim 4, wherein said coating material is a non-ferrous metal coating.

17. An arrangement according to claim 16, wherein said coating material is zinc.

18. An arrangement according to claim 6, wherein said polygonal cross-section corresponds in shape to said openings in said fabric, the cross-sectional size of said teeth being smaller than said openings.

* * * * *